US005755109A

United States Patent [19]

Kim

[11] Patent Number: 5,755,109

[45] Date of Patent: May 26, 1998

[54] STRUCTURE FOR MOUNTING EVAPORATOR PIPE IN REFRIGERATORS

[75] Inventor: Ik Guen Kim, Suwon, Rep. of Korea

[73] Assignee: Samsung Electronics Co., Ltd., Suwon, Rep. of Korea

[21] Appl. No.: 722,800

[22] Filed: Sep. 27, 1996

[30] Foreign Application Priority Data

Nov. 30, 1995 [KR] Rep. of Korea ..... 1995-45716

[51] Int. Cl.[6] ..... F25D 23/00

[52] U.S. Cl. ..... 62/259.1; 62/298; 248/56; 403/375

[58] Field of Search ..... 248/56; 285/192, 285/194; 403/375; 62/259.1, 298

[56] References Cited

U.S. PATENT DOCUMENTS

| | | | |
|---|---|---|---|
| 1,494,234 | 5/1924 | Gossett | 248/56 |
| 1,914,198 | 6/1933 | Davis, Jr. et al. | 285/192 |
| 1,952,695 | 3/1934 | Webb et al. | 285/192 |
| 3,134,188 | 5/1964 | Petersen | 248/56 |
| 3,162,412 | 12/1964 | McEntire | 285/192 |
| 4,346,568 | 8/1982 | Perrone et al. | 62/259.1 |
| 4,730,363 | 3/1988 | Asbaghi | 248/56 |
| 5,186,022 | 2/1993 | Kim | 62/515 |
| 5,201,190 | 4/1993 | Nelson et al. | 62/210 |

*Primary Examiner*—William E. Tapolcai

*Attorney, Agent, or Firm*—Burns, Doane, Swecker & Mathis, L.L.P.

[57] ABSTRACT

A refrigerator includes a compressor and an evaporator interconnected by a refrigerant conducting tube. The tube passes through an opening in an internal wall of the refrigerator. The opening is formed by cutting a U-shaped slit into the wall, thereby forming an elastic plate, and then forming a groove having an open access end coinciding with a section of the slit. By elastically flexing the plate, the access end of the groove becomes exposed to enable the tube to be inserted into the groove. When the plate is released, it snaps back to a position wherein an edge thereof extends across the access end and keeps the tube pressed within the groove.

7 Claims, 2 Drawing Sheets

STRUCTURE FOR MOUNTING EVAPORATOR PIPE IN REFRIGERATORS

BACKGROUND OF THE INVENTION

1. Field of the Invention

The present invention relates, in general, to a structure for mounting an evaporator pipe in refrigerators.

2. Description of the Prior Art

A typical refrigerating system for refrigerators is schematically shown in FIG. 1. As shown in the drawing, the typical refrigerating system includes a compressor 4, which receives the low temperature and low pressure refrigerant gas through a suction pipe 1 and compresses the refrigerant gas in order to provide high temperature and pressurized refrigerant gas and supplies the pressurized hot refrigerant gas to a condenser 3. The above refrigerating system also includes a capillary tube 5, wherein the pressurized hot refrigerant gas emits heat to the atmospheric air so that the refrigerant gas is condensed and becomes liquid refrigerant. The refrigerating system further includes an evaporator 6, wherein the low temperature liquid refrigerant absorbs heat from air thus cooling the air. The cold air generated by the evaporator 6 is distributed into the freezer and refrigeration compartments of a refrigerator by a blower.

The cold air generated by the evaporator of the above refrigerating system is sucked into the freezer and refrigeration compartments by the suction force of a fan and repeatedly circulates inside the compartments. The fan is only turned on when a freezer thermostat, which automatically controls the temperature inside the freezer compartment, is actuated.

U.S. Pat. Nos. 5,186,022 and 5,201,190 disclosed the construction of a typical evaporator with an evaporator pipe.

FIGS. 2A and 2B show a typical structure for mounting the evaporator pipe in refrigerators. As shown, the low temperature and low pressure refrigerant gas coming out of the evaporator 6 flows into the compressor through an evaporator pipe 7. The evaporator pipe 7 comprises a capillary tube 5 and suction pipe 1, which are taped up together into a single body. The pipe 7 passes through a circular hole 8A of the inner cabinet 8 and extends to the compressor 4.

In the above pipe mounting structure, the evaporator pipe 7 has an enlarged external size since it is formed by taping up the capillary tube 5 and suction pipe 1 into a single body. In order to receive such an enlarged size pipe 7, the diameter of the hole 8A must be enlarged. The hole 8A with such an enlarged diameter may leak foaming liquid when foaming in an insulation layer. In order to prevent the leakage of the foaming liquid through the hole 8A, the hole 8A of the inner cabinet 8 is sealed by taping up the hole 8A a sealing means 9. However, the above pipe mounting structure has a problem in that it is difficult to seal the hole 8A since the hole 8A has a large area to be sealed.

SUMMARY OF THE INVENTION

It is, therefore, an object of the present invention to provide a structure for mounting an evaporator pipe in refrigerators in which the above problems can be overcome and which not only simplifies the process of sealing the pipe accommodating portion of the inner cabinet, but also prevents leakage of foaming liquid through the pipe accommodating portion when foaming an insulator after passing the evaporator pipe through the inner cabinet.

In order to accomplish the above object, a structure for mounting an evaporator pipe in accordance with the preferred embodiment of the invention comprises a groove formed on an inner cabinet of a refrigerator and adapted for accommodating passage of the evaporator pipe therethrough in order to mount the pipe to the inner cabinet, and a plate provided on the inner cabinet and adapted for preventing leakage of foaming liquid through the inner cabinet when foaming an insulator after passing the evaporator pipe through the groove.

The plate is formed by cutting a U-shaped slit into the cabinet thereby being provided with elasticity.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
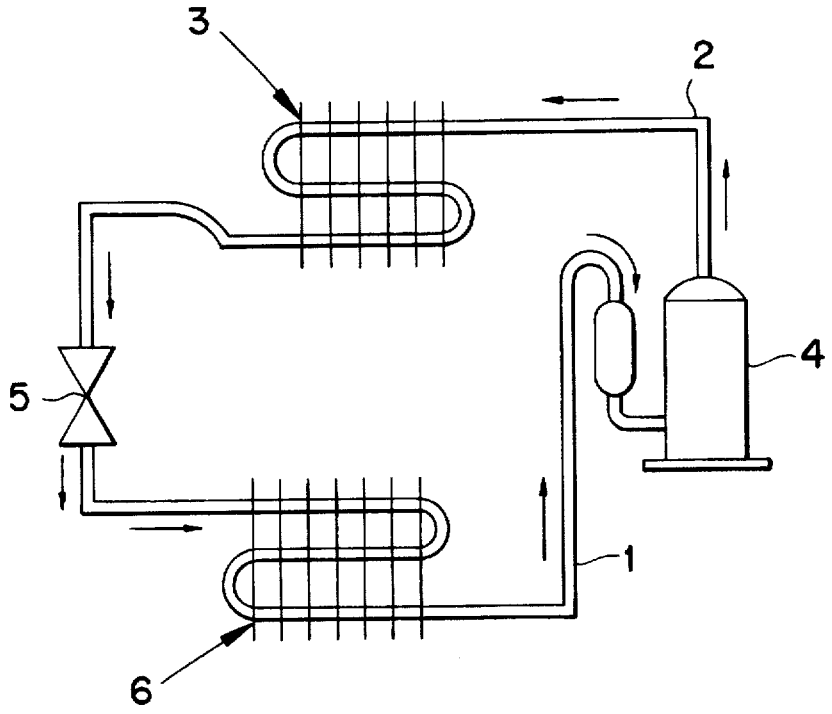
FIG. 1 is a schematic diagram showing the construction of a typical prior art refrigerating system for refrigerators.
Figure 2A:
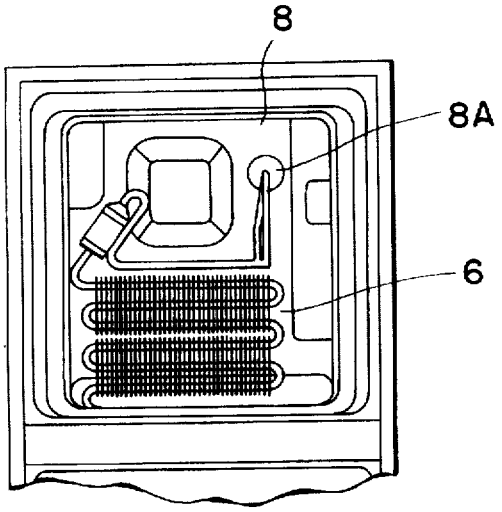
FIG. 2A PRIOR ART
FIG. 2A is a front elevational view of a prior art structure for mounting the evaporator pipe in a refrigerator.
Figure 2B:
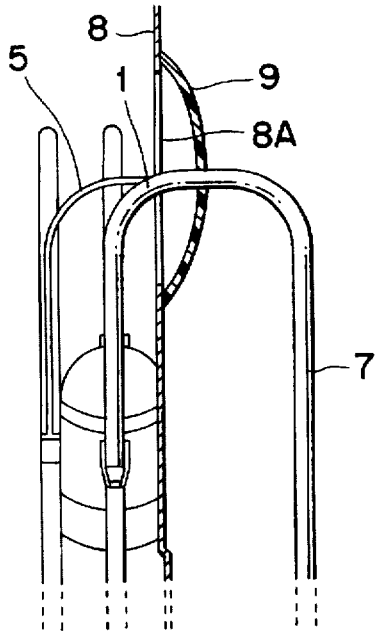
FIG. 2B PRIOR ART
FIG. 2B is a vertical view through an inner cabinet of FIG. 2A without an evaporator tube being installed.
Figure 3A:
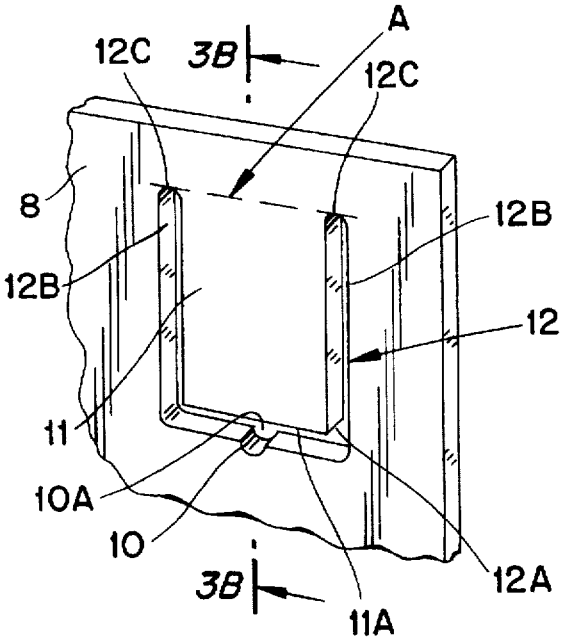
FIG. 3A is a perspective view of a portion of a cabinet for mounting the evaporator pipe in a refrigerator in accordance with the preferred embodiment of the present invention and FIG. 3B is a sectional view taken along the line 3B—3B of FIG. 3A, with an evaporator tube installed.
Figure 3B:
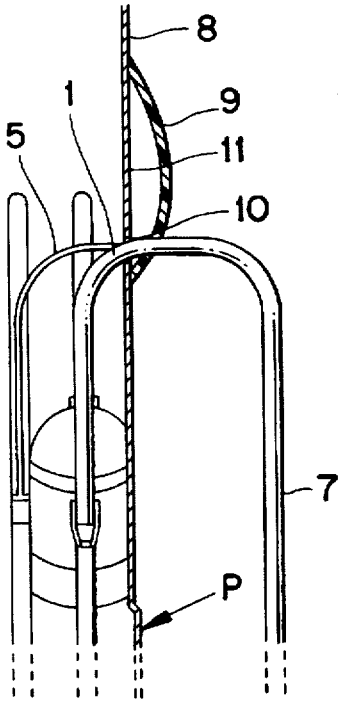

FIGS. 3A and 3B show a structure for mounting the evaporator pipe in a refrigerator in accordance with the preferred embodiment of the present invention. In the structure of this invention, a U-shaped slit is cut into an inner wall or cabinet 8 thus forming an elastic plate 11. A groove 10 is formed on the center of a horizontal section 12A of the slit 12. That horizontal section 12A interconnects lower ends of vertical sections 12B of the slit 12. That is, the slit includes a first section 12A having opposite ends from which second and third slit sections 12B, 12B extend. Each of the second and third slit sections 12B, 12B terminates in a closed end 12C spaced from a respective one of the opposite ends of the first section 12A. Those closed ends 12C, 12C are interconnected by a portion of the wall which thus forms a pivot axis A for the plate 11, enabling a free edge 11A of the plate to move in a direction out of a plane P of the wall 8. The entire slit 12 is spaced from all outer edges of the wall 8. When mounting the evaporator pipe 7, which is formed by taping up the capillary tube 5 and suction pipe 1 into a single body, to the inner cabinet 8, the evaporator pipe 7 passes through the groove 10. The plate 11 prevents leakage of the foaming liquid when foaming in an insulation layer after passing the evaporator pipe 7 through the groove 10.

The reference numeral 9 denotes a sealing means, which seals the pipe accommodating portion 10, 12 of the inner cabinet 8 in order to prevent leakage of the foaming liquid when foaming in the insulation after passing the pipe 7 through the cabinet 8.

The operational effect of the above structure will be described hereinbelow.

In order to connect the evaporator pipe 7, which is formed by taping up the capillary tube 5 and suction pipe 1 into a single body, to the compressor 4, the pipe 7 is passed through the groove 10 of the inner cabinet 8. When passing the pipe 7 through the groove 10 of the cabinet 8, the plate 11 is elastically bent thus enlarging the size of the groove 10 and thereby allowing the pipe 7, which has a diameter larger than the original size of the groove 10, to smoothly pass through an open access end of 10A of the groove 10. That access end 10A coincides with the horizontal section.

After the pipe 7 passes through the groove 10, the plate 11 elastically returns to its original or rest position so that the bottom edge 11A of the plate 11 extends across the access end 10A and compresses the pipe 7 onto the groove 10. Therefore, it is possible to easily seal the pipe-accommodating portion of the cabinet 8 using the sealing means 9.

While sealing the pipe accommodating portion of the cabinet 8, the sealing means 9 need only be applied to a U-shaped slit 12 of the cabinet 8 so that it is not necessary to totally seal a large hole such as the large hole 8A of the prior art structure. The structure of this invention thus reduces the amount of sealing means 9 and simplifies the scaling process.

In addition, the structure of this invention prevents leakage of the foaming material through the inner cabinet 8.

As described above, the present invention provides an improved structure for mounting the evaporator pipe to the inner cabinet of a refrigerator. The structure of this invention allows the pipe-accommodating portion of the inner cabinet to be easily sealed. The above pipe mounting structure thus improves work efficiency and prevents leakage of foaming liquid through the inner cabinet when foaming an insulator after passing the evaporator pipe through the cabinet.

Although the preferred embodiments of the present invention has been disclosed for illustrative purposes, those skilled in the art will appreciate that various modifications, additions and substitutions are possible, without departing from the scope and spirit of the invention as disclosed in the accompanying claims.

What is claimed is:

1. In a refrigerator having a compressor, a housing forming an evaporator compartment, an evaporator disposed in the evaporator compartment, a wall forming one side of the evaporator compartment, and an evaporator pipe extending through an opening in the wall for interconnecting the evaporator and compressor to conduct refrigerant therebetween, the improvement wherein the opening comprises a groove including an open access end through which the evaporator pipe is inserted, the wall including a plate formed of one piece with the wall and having an edge extending across the access end of the groove when the evaporator tube is disposed therein.

2. The improvement according to claim 1 wherein the wall includes outer edges, the plate being formed by a slit cut into the wall, the slit spaced from all of the outer edges of the wall.

3. The improvement according to claim 1, the plate being elastically flexible and having a rest position in which an edge of the plate extends across the access end, the plate being elastically movable in a direction to displace the edge thereof out of a plane of the wall and away from the access for enabling the evaporator pipe to be inserted into the groove.

4. The improvement according to claim 3, wherein the wall includes outer edges, the plate being formed by a slit cut in the wall, the slit spaced from all of the outer edges of the wall.

5. The improvement according to claim 3 wherein the edge of the plate presses the evaporator pipe into the groove.

6. The improvement according to claim 4 wherein the slit is generally U-shaped, the slit including a first section having opposite ends, and second and third sections extending from respective ones of the opposite ends; each of the second and third sections terminating in a closed end spaced from a respective one of the opposite ends; the closed ends being interconnected by a portion of the wall forming a pivot axis for the plate.

7. The improvement according to claim 6 wherein the access end of the groove coincides with the first section of the slit.

* * * * *